US005252798A

United States Patent [19]

Kamada

[11] Patent Number: 5,252,798

[45] Date of Patent: Oct. 12, 1993

[54] ILLUMINATED SWITCH APPARATUS

[75] Inventor: Soetsu Kamada, Furukawa, Japan

[73] Assignee: Alps Electric Co., Ltd., Tokyo, Japan

[21] Appl. No.: 788,327

[22] Filed: Nov. 5, 1991

[30] Foreign Application Priority Data

Nov. 15, 1990 [JP] Japan ..... 2-118862[U]

[51] Int. Cl.[5] ..... H01H 9/00

[52] U.S. Cl. ..... 200/314; 200/310; 200/312; 200/313

[58] Field of Search ..... 200/314, 310, 311, 312, 200/313, 341, 292, 517, 344, 342, 345

[56] References Cited

U.S. PATENT DOCUMENTS

| | | | |
|---|---|---|---|
| 4,225,766 | 9/1980 | Pfeifer et al. | 200/314 |
| 4,293,764 | 10/1981 | Amrhein | 200/314 |
| 4,334,134 | 6/1982 | Janda | 200/314 |
| 4,788,447 | 11/1988 | Kiyono et al. | 307/10 |
| 5,115,106 | 5/1992 | Weiland et al. | 200/517 |

*Primary Examiner*—Henry J. Recla
*Assistant Examiner*—David J. Walczak
*Attorney, Agent, or Firm*—Guy W. Shoup; Patrick T. Bever

[57] ABSTRACT

A light irradiating switch apparatus which is comparatively small in vertical dimension and low in production cost. The light irradiating switch apparatus comprises a casing, a printed circuit board mounted on the casing, a switch element mounted on the printed circuit board, a light source mounted on the printed circuit board, a light intercepting slide member mounted for sliding movement in the casing, and a light transmitting key top mounted on the slide member and having an indicating portion thereon. The printed circuit board having a slot formed therein in such a manner as to surround the light source, and the slide member has an end portion fitted in the slot of the printed circuit board for movement in a perpendicular direction to the printed circuit board.

4 Claims, 2 Drawing Sheets

ILLUMINATED SWITCH APPARATUS

BACKGROUND OF THE INVENTION

1. Field of the Invention

This invention relates to a light irradiating switch apparatus.

2. Description of Related Art

Illuminated switches are used in many applications. One example is in an automobile where a number of illuminated switches may be used to control the air flow of an air conditioning system.

FIG. 5 shows an exemplary one of conventional illuminated switch apparatus of the type just mentioned. Referring to FIG. 5, the switch apparatus shown includes a key top 1, a casing 6, a printed circuit board 5 mounted at a lower end of the casing 6, a switch element 2 and two light sources such as, for example, a lamp 3 and a light emitting diode (LED) 4 all mounted on the printed circuit board 5, a light intercepting slide member 7 having the key top 1 mounted at an end thereof and having the other end fitted for sliding movement in the casing 6, and a cover 8 for covering over a bottom end of the casing 6.

The key top 1 has a body 9 molded from a resin material having a high light transmittance. A colored, light transmitting paint layer 10 is applied to a surface of the body 9, and a light intercepting outer layer 11 is formed by vacuum vapor deposition or sputtering on a surface of the light transmitting paint layer 10. The outer layer 11 is partially removed by means of a laser beam to form a first indicating portion 12 for indicating a spit hole, and both of the light intercepting paint layer 10 and outer layer 11 are partially removed by means of a laser beam to expose a transparent resin piece 13 made of an acrylic resin material to form a second indicating portion 14.

The key top 1 is integrally attached to the slide member 7.

The slide member 7 is formed in a tubular profile from a light intercepting material such as, for example, an ABS (acrylonitrile-butadiene-styrene) resin to which black pigment is added. The slide member 7 has formed in a top wall thereof a first perforation 15 for allowing light from the lamp 3 to irradiate upon the first indicating portion 12 and a second perforation 16 for allowing light from the LED 4 to irradiate upon the second indicating portion 14, and a light intercepting wall 17 is provided vertically between the two perforations 15 and 16.

A holder 19 for holding the LED 4 thereon is mounted uprightly on the printed circuit board 5 between a right side plate 18 and the light intercepting wall 17. A recessed portion 20 is formed at a portion of the holder 19 at which the holder 19 is mounted on the printed circuit board 5, and lower end portions of the light intercepting wall 17 and right side plate 18 are inserted in the recessed portion 20 of the holder 19 such that they are overlapped with a rising portion 21 of the holder 19 which defines the recessed portion 20.

Since the illuminated switch apparatus is constructed such that the end portion of the light intercepting wall 17 of the slide member 7 is inserted in the recessed portion 20 provided on the holder 19 such that, whether the key top 1 is depressed or not, the end portion of the light intercepting wall 17 is overlapped with the rising portion 21 of the holder 19, it is possible to prevent light from the lamp 3 from irradiating upon the second indicating portion 14 and also to prevent light from the LED 4 from irradiating upon the first indicating portion 12.

With the conventional illuminated switch apparatus described above, however, since the end portion of the light intercepting wall 17 of the slide member 7 is inserted in the recessed portion 20 of the holder 19 such that it is overlapped with the rising portion 21 of the holder 19, the slide member 7 must be positioned, taking a downward stroke of the key top 1 into consideration, at a location spaced upwardly by a distance equal to such stroke of the key top 1. Accordingly, the conventional illuminated switch apparatus has a drawback that the height or vertical dimension H between the top face of the key top 1 and the bottom face of the printed circuit board 5 is greater than the length of the eight intercepting wall plus the length of the downward key stroke. Besides, since the holder 19 is required, the number of parts is greater and a corresponding high production cost is required.

SUMMARY OF THE INVENTION

It is an object of the present invention to provide a illuminated switch apparatus which is cheaper to produce and can be reduced in overall size.

In order to attain the object, according to the present invention, there is provided a illuminate switch apparatus which comprises a casing, a printed circuit board mounted on the casing, a switch element mounted on the printed circuit board, a light source mounted on the printed circuit board, a light intercepting slide member mounted for sliding movement in the casing, and a light transmitting key top mounted on the slide member and having an indicating portion thereon, the printed circuit board having a slot formed therein in such a manner as to surround the light source, the slide member having an end portion fitted in the slot of the printed circuit board for movement in a perpendicular direction to the printed circuit board.

With the illuminate switch apparatus, since the end portion of the slide member is fitted for movement in a perpendicular direction to the printed circuit board in the slot of the printed circuit board which is formed in such a manner as to surround the light source mounted on the printed circuit board, even where a stroke of the key top is equal, the height or vertical dimension between the bottom face of the printed circuit board and the top face of the key top can be reduced, and consequently, the illuminate switch apparatus can be reduced in overall size as much. Further, since such holder for the light source as in the conventional illuminated switch apparatus described above is eliminated, the number of components is reduced as much and the production cost is reduced as much.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1:
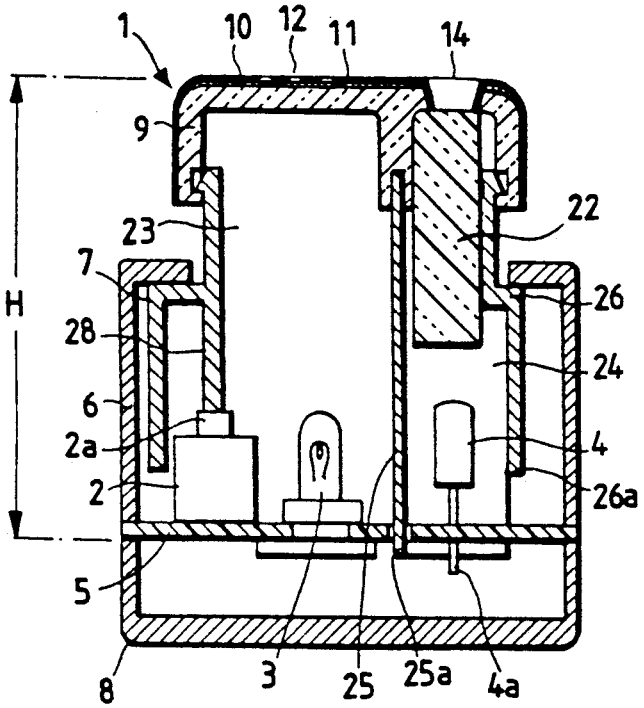
FIG. 1 is a vertical sectional view of a light irradiating switch apparatus showing a preferred embodiment of the present invention.

Referring first to FIG. 1, there is shown a illuminated switch apparatus to which the present invention is applied. The illuminated switch apparatus shown has a somewhat common construction to the light irradiating switch apparatus described hereinabove with reference to FIG. 5 and includes a key top 1 which includes a body 9 made of a transparent resin, a colored, light transmitting paint layer 10 applied to a surface of the body 9, and a light intercepting outer layer 11 formed by vacuum vapor deposition or sputtering on a surface of the light transmitting paint layer 10.

Figure 2:
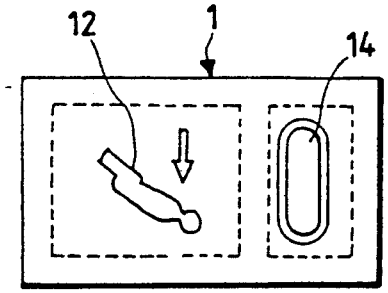
FIG. 2 is a top plan view of a key top of the light irradiating switch apparatus of FIG. 1.

The outer layer 11 is partially removed by means of a laser beam to form a first indicating portion 12 as shown in FIG. 2, and both of the light transmitting paint layer 10 and outer layer 11 are partially removed by means of a laser beam to expose a transparent resin piece 22 made of an acrylic resin or the like to form a second indicating portion 14 as shown in FIG. 2.

Figure 3:
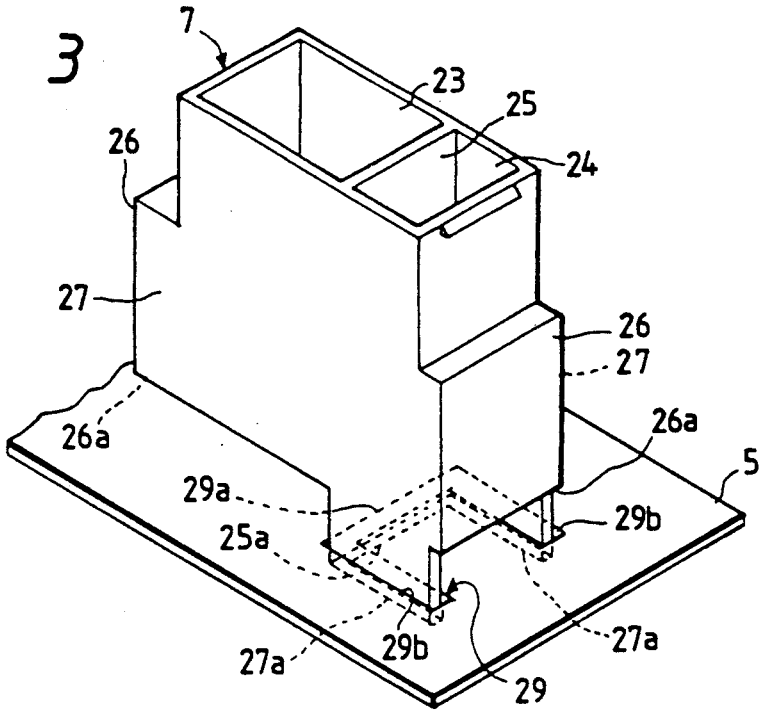
FIG. 3 is a perspective view illustrating a slide member mounted on a printed circuit board of the light irradiating switch apparatus of FIG. 1.

The illuminated switch apparatus further includes a slide member 7 which is shaped in such a hollow tubular profile having the bottom opened as shown in FIG. 3, and is formed from a light intercepting material such as an ABS resin to which black pigment is added.

Referring to FIG. 3, the slide member 7 has formed at the top thereof a first perforation 23 for allowing light from a lamp 3 to irradiate upon the first indicating portion 12 of the key top 1 and a second perforation 24 for allowing light from an LED to irradiate upon the second indicating portion 14. The slide member 7 has a light intercepting wall 25 formed thereon vertically between the two perforations 23 and 24 for preventing light from the lamp 3 from irradiating upon the second indicating portion 14 and also for preventing light from the LED from irradiating upon the first indicating portion 12. The slide member 7 further has a pair of outwardly stepped portions 26 having lower end faces 26*a* set lower than the height of four side plates 27 of the slide member 7. A pressing portion 28 for pressing a switch element 2 is provided on an inner side face of the first perforation 23 of the slide member 7 as seen from FIG. 1.

Figure 4:
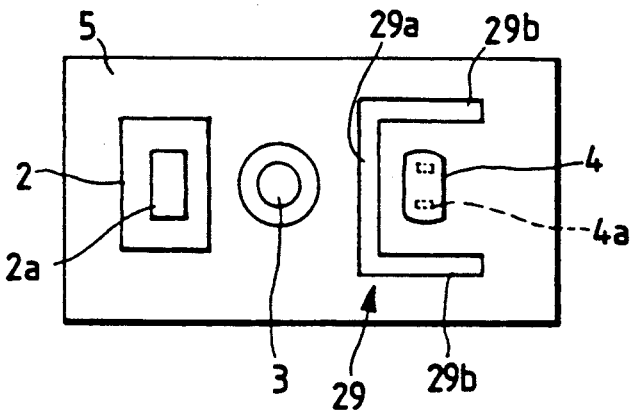
FIG. 4 is a plan view of the printed circuit board shown in FIG. 3.
Figure 5:
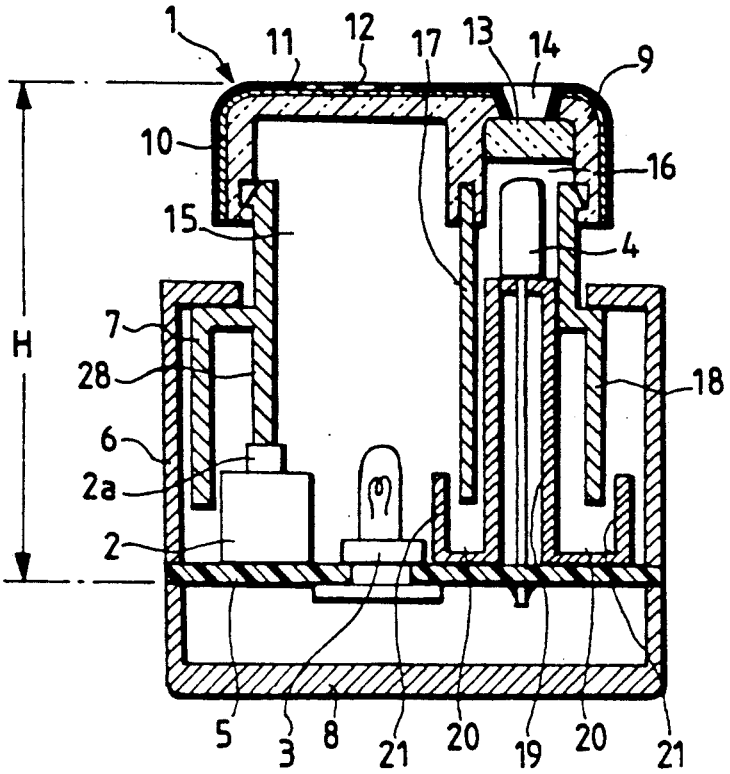
FIG. 5 PRIOR ART
FIG. 5 is a vertical sectional view showing a conventional illuminated switch apparatus.

Referring to FIGS. 1 and 3, the switch element 2 and the two light sources including the lamp 3 and LED 4 are mounted on a printed circuit board 5 similarly as in the conventional illuminated switch apparatus described hereinabove with reference to FIG. 5. The printed circuit board 5, however, has a channel-shaped slot 29 performed therein in such a manner as to surround the LED 4 as seen in FIG. 4. The channel-shaped slot 29 has a transverse portion 29*a* and a pair of lateral portions 29*b* extending perpendicularly from the opposite ends of the transverse portion 29*a*. A lower end portion 25*a* of the light intercepting wall 25 of the slide member 7 extends through the transverse portion 29*a* of the channel-shaped slot 29 while end portions 27*a* of a pair of opposing ones of the side plates 27 of the slide member 7 extend through the lateral portions 29*b* of the channel-shaped slot 29.

The LED 4 has a pair of leads 4*a* which are short as seen in FIG. 1 and are mounted on the printed circuit board 5. Since the leads 4*a* are not so long as in such conventional illuminated switch apparatus as described above, they need not be held by such a holder 19 as in the conventional illuminated switch apparatus, and accordingly, the holder 19 is omitted. Instead, the transparent resin piece 22 made of an acrylic resin or the like is elongated in a vertically downward direction so that a lower end thereof may be disposed in the proximity of the LED 4. It is to be noted that, while the slot 29 perforated in the printed circuit board 5 described above has a channel shape as seen in FIG. 4, it may have any other shape only if it surrounds the LED 4.

The remaining part of the illuminated switch apparatus has a similar structure to that of the conventional illuminated switch apparatus described hereinabove, and accordingly, description thereof will be omitted herein to avoid redundancy.

The illuminated switch apparatus having such construction as described above will be used in the following manner.

If the key top 1 is depressed with a finger or the like to move the slide member 7 downwardly along an inner wall face of the casing 6, then an operating portion 2*a* of the switch element 2 is pressed to move downwardly by the switch pressing portion 28 of the slide member 7 to put the switch element 2 into an on-state. Such condition is held by a locking mechanism not shown. In response to such switching on operation of the switch element 2, the LED 4 is lit to emit light therefrom, and the first indicating portion 14 of the key top 1 is irradiated upon by the light thus emitted from the LED 4. Accordingly, the operator can recognize that the illuminated switch apparatus is in an on-state by visually observing the first indicating portion 14 of the key top 1 thus irradiated upon by the light.

If the key top 1 is depressed, in the on-state of the illuminated switch apparatus, again by a finger or the like, the locked condition described above is cancelled, and consequently, the key top 1, slide member 7 and switch element 2 are returned to their respective original positions shown in FIG. 1 by means not shown. Thereupon, the switch element 2 is returned into an off-state and the LED 4 is extinguished.

On the other hand, if headlamps of an automobile in which the illuminated switch apparatus is incorporated are lit at night or at a dark place, in a tunnel or the like, then the lamp 3 is lit whether the switch element 2 is on or off.

Consequently, the operator can confirm the function of the key top 1 at such dark place by visually observing the second indicating portion 12 of the key top 1 thus irradiated upon by light from the lamp 3.

According to the illuminated switch apparatus of the embodiment described above, since the channel-shaped slot 29 is perforated in the printed circuit board 5 such that it surrounds the LED 4 and the end portion 25*a* of the light intercepting wall 25 provided on the slide member 7 extends into the transverse portion 29*a* of the slot 29 while the end portions 27*a* of the opposing side plates 27 extend into the opposing lateral portions 29*b* of the slot 29 such that they may surround the LED 4 to intercept light from the LED 4, otherwise possible irradiation of light of the lamp 3 upon the second indicating portion 14 of the key top 1 can be prevented while otherwise possible irradiation of light of the LED 4 upon the first indicating portion 12 of the key top 1 can be prevented. Accordingly, the illuminated switch apparatus is superior in visual observability.

Further, since end faces of the slide member 7, that is, the end portion 25*a* of the light intercepting wall 25 and the end portions 27*a* of the opposing side plates 27, extend downwardly through and from the channel-shaped slot 29 of the printed circuit board 5, the height or vertical dimension H between the bottom face of the printed circuit board 5 and the top face of the key top 1 can be reduced comparing with that of such conventional illuminated switch apparatus as described hereinabove. Consequently, the illuminated switch apparatus can be minimized in overall size. Further, since such holder 19 for the LED 4 as in the conventional illuminated switch apparatus can be eliminated, the number of components is reduced as much and the production cost is reduced as much.

Having now fully described the invention, it will be apparent to one of ordinary skill in the art that many changes and modifications can be made thereto without departing from the spirit and scope of the invention as set forth herein.

What is claimed is:

1. An illuminated switch apparatus, comprising a casing, a printed circuit board mounted on said casing, a switch element mounted on said printed circuit board, a light source mounted on said printed circuit board, a light intercepting slide member having a switch actuation portion and mounted for sliding movement in said casing, and a light transmitting key top mounted on said slide member and having an indicating portion thereon, said printed circuit board having a slot formed therein in such a manner as to substantially surround said light source, said slide member having an end portion adapted to substantially surround said light source and is complementarily received in said slot of said printed circuit board for movement in a perpendicular direction to said printed circuit board whereby when said key top is depressed said end portion slides through said slot and said actuation portion actuates said switch element.

2. An illuminated switch apparatus according to claim 1, further comprising a second light source mounted on said printed circuit board adjacent said switch element, said key top having a second indicating portion for being irradiated upon by light from said second light source.

3. An illuminated switch apparatus according to claim 2, wherein said slot of said printed circuit board has a channel shape while said end portion of said light intercepting slide member has a similar channel shape in such a manner as to surround said first-mentioned light source.

4. An illuminated switch apparatus according to claim 1, further comprising a transparent element mounted at said indicating portion of said key top and having an end face located in the proximity of and in an opposing relationship to said light source.

* * * * *